US008113764B2

(12) United States Patent
Hernandez et al.

(10) Patent No.: US 8,113,764 B2
(45) Date of Patent: Feb. 14, 2012

(54) STEAM TURBINE AND A METHOD OF DETERMINING LEAKAGE WITHIN A STEAM TURBINE

(75) Inventors: Nestor Hernandez, Schenectady, NY (US); Dhaval Ramesh Bhalodia, Conyngham, PA (US)

(73) Assignee: General Electric Company, Schenectady, NY (US)

( * ) Notice: Subject to any disclaimer, the term of this patent is extended or adjusted under 35 U.S.C. 154(b) by 1000 days.

(21) Appl. No.: 12/052,290

(22) Filed: Mar. 20, 2008

(65) Prior Publication Data

US 2009/0238679 A1 Sep. 24, 2009

(51) Int. Cl.
*F04D 27/02* (2006.01)

(52) U.S. Cl. ..... 415/1; 415/118; 415/168.2; 415/168.4

(58) Field of Classification Search ..... 415/168.2, 415/168.4, 118, 229, 230, 1
See application file for complete search history.

(56) References Cited

U.S. PATENT DOCUMENTS

| | | | | |
|---|---|---|---|---|
| 3,604,206 | A * | 9/1971 | Baily | 60/644.1 |
| 3,817,654 | A | 6/1974 | Sohma | |
| 3,959,973 | A * | 6/1976 | Meylan | 60/657 |
| 4,550,569 | A | 11/1985 | Isa et al. | |
| 5,149,247 | A * | 9/1992 | Gros et al. | 415/108 |
| 5,906,095 | A | 5/1999 | Frutschi et al. | |
| 6,102,654 | A | 8/2000 | Oeynhausen et al. | |
| 6,237,338 | B1 | 5/2001 | Magoshi et al. | |
| 6,442,924 | B1 * | 9/2002 | Talley et al. | 60/783 |
| 6,502,403 | B1 * | 1/2003 | Tazaki et al. | 60/784 |
| 7,003,956 | B2 | 2/2006 | Yamashita et al. | |
| 7,056,084 | B2 | 6/2006 | Nagane et al. | |
| 2004/0261417 | A1 | 12/2004 | Yamashita et al. | |

FOREIGN PATENT DOCUMENTS

| | | | |
|---|---|---|---|
| EP | 1050666 | B1 | 8/2000 |
| JP | 58113501 | A2 | 7/1983 |
| JP | 09177505 | A2 | 7/1997 |
| JP | 09317405 | A2 | 12/1997 |

* cited by examiner

*Primary Examiner* — Edward Look
*Assistant Examiner* — Adam W Brown
(74) *Attorney, Agent, or Firm* — Cantor Colburn LLP

(57) ABSTRACT

A steam turbine includes a shaft operatively connecting a first turbine section and a second turbine section. A packing assembly is positioned about the shaft. A first conduit is fluidly connected to the packing assembly. The first conduit is configured to introduce a flow of low temperature, low pressure steam to the packing assembly. A second conduit is also fluidly connected to the packing assembly downstream from the first turbine section and upstream from the first conduit. The second conduit receives a portion of the high temperature, high pressure steam passing into the packing assembly from the first turbine section. A valve is fluidly connected to the second conduit. The valve is configured to be selectively operated so as to allow the high temperature, high pressure steam to mix with the low pressure, low temperature steam in the second conduit.

14 Claims, 2 Drawing Sheets

STEAM TURBINE AND A METHOD OF DETERMINING LEAKAGE WITHIN A STEAM TURBINE

BACKGROUND OF THE INVENTION

The present invention is directed to a power plant and, more particularly, to a system and method of determining leakage within a steam turbine.

Most steam turbines having opposing high pressure (HP) and intermediate pressure (IP) sections running at a hot reheat temperature in excess of 1050° F. (566° C.) require an external cooling system in order to maintain acceptable first reheat stage stress levels. As a result of an interaction between the cooling system and internal leakages between HP and IP sections, it is difficult to determine an amount steam leaking between the HP and IP sections. More specifically, in operation, a running clearance exists between a shaft interconnecting the HP and IP sections and a packing assembly that provides a seal about the shaft. The running clearance allows high pressure, high temperature steam to leak from the HP section, along the shaft, to the IP section. The high pressure, high temperature steam leakage affects an overall efficiency of the steam turbine. That is, as steam leakage increases, steam turbine performance decreases.

There have been numerous attempts to determine the amount of leakage in order to adjust the running clearance and packing geometry for enhanced steam turbine performance. At present, an inference method is employed to calculate the amount of leakage. The inference test relies upon measuring an effect on an exit portion of the IP section resulting from changes made to parameters at an inlet portion of the HP section. In essence, the inference method measures an indirect parameter in order to determine enthalpy changes in the exit portion of the IP section to estimate the amount of steam leaking along the shaft. Employing an indirect measurement to determine an amount of leakage results in a solution that is, at best, one step above a guess. Determining the amount of leakage will enable engineers to adjust the running clearance and packing geometry between the shaft and the packing assembly to create added efficiencies in steam turbine operation. Without knowing, within some level of certainty, the amount of high temperature, high pressure steam leaking along the shaft, adjusting the running clearance and packing geometry to enhance steam turbine performance will remain a time consuming, high cost, and inexact trial and error process.

BRIEF DESCRIPTION OF THE INVENTION

A steam turbine constructed in accordance with exemplary embodiments of the present invention includes a first turbine section having a flow of high temperature steam, a second turbine section and a shaft operatively connecting the first turbine section and the second turbine section. The steam turbine further includes a packing assembly positioned about the shaft. The packing assembly limits an amount of the flow of high pressure steam passing along the shaft from the first turbine section to the second turbine section. A first conduit is fluidly connected to the packing assembly. The first conduit is configured to introduce a flow of low temperature, low pressure steam to the packing assembly. A second conduit is also fluidly connected to the packing assembly downstream from the first turbine section and upstream from the first conduit. The second conduit receives a portion of the high temperature, high pressure steam passing into the packing assembly from the first turbine section. A valve is fluidly connected to the second conduit. The valve is configured to be selectively operated so as to allow the high temperature, high pressure steam to mix with the low pressure, low temperature steam in the second conduit.

Exemplary embodiments of the present invention also include a method of determining a leakage within a steam turbine having first and second opposing turbine sections connected by a shaft surrounded by a packing assembly. The first turbine section leaks high temperature high pressure steam along the shaft within the packing assembly. The steam turbine includes a first and second conduits connected to the packing assembly with the second conduit being positioned between the first conduit and the first turbine section. The method includes guiding the high temperature, high pressure steam through the second conduit, and introducing a low temperature, low pressure steam into the first conduit. The low temperature, low pressure steam is passed along the shaft toward the second conduit. The method further requires operating a valve fluidly connected to the second conduit, and mixing the high temperature, high pressure steam and the low temperature, low pressure steam in the second conduit to form a combined steam flow. At least one parameter of the combined steam flow is measured, and the valve is adjusted until the at least one parameter of the combined steam flow drops relative to a corresponding parameter of the high temperature, high pressure steam flow. An amount of high temperature, high pressure steam leaking from the first turbine section along the shaft toward the second turbine section is calculated based on the combined steam flow.

Additional features and advantages are realized through the techniques of exemplary embodiments of the present invention. Other exemplary embodiments and aspects of the invention are described in detail herein and are considered a part of the claimed invention. For a better understanding of the invention with advantages and features thereof, refer to the description and to the drawings.

DETAILED DESCRIPTION OF THE INVENTION

Figure 1:
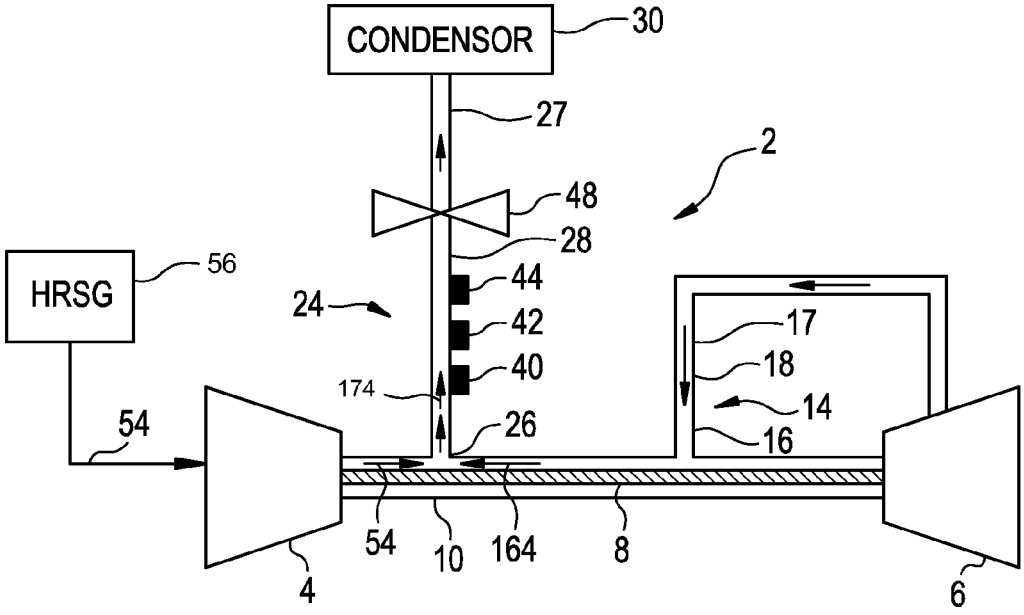
FIG. 1 is a schematic represent of a steam turbine having opposed high pressure (HP) and intermediate pressure (IP) turbines constructed in accordance with exemplary embodiments of the present invention.

With initial reference to FIG. 1, a steam turbine which, in accordance with an exemplary embodiment of the present invention, is shown as part of a combined cycle steam turbine (CCP) is generally indicated at 2. Steam turbine 2 includes a first or high pressure (HP) turbine section 4 operatively connected to an opposing second or intermediate pressure (IP) turbine section 6 by a shaft 8. A mid packing assembly 10 extends about shaft 8. Mid packing assembly 10 includes a plurality of packing rings (not shown) that provide a seal about shaft 8. Steam turbine 2 also includes a first conduit 14 fluidly connected to packing assembly 10. First conduit 14 includes a first end section 16, fluidly connected to packing assembly 10, which extends to a second end section 17 through an intermediate section 18. In accordance with the exemplary embodiment shown, second end section 17 connects to an IP bowl section (not separately labeled) of second turbine section 6. Steam turbine 2 further includes a second conduit 24 having a first end portion 26 fluidly connected to packing assembly 10, that extends to a second end portion 27 through an intermediate portion 28. Second end portion 27 connects to a condenser unit 30 in the exemplary embodiment shown. However, it should be understood that second end portion 27 could connect to any lower pressure unit associated with steam turbine 2. Second conduit 24 is shown to include a pressure sensor 40 for sensing a pressure parameter of steam in second conduit 24, a temperature sensor 42 for sensing a temperature parameter of steam in conduit 24, a flow meter 44 for sensing a flow parameter of steam in second conduit 24 and a valve 48. In the exemplary embodiment shown, valve 48 is electrically operated to control a flow of steam passing through second conduit 24. However, it should be understood that valve 48 can also be manually operated.

First turbine section 4 receives a flow of high temperature/high pressure (ht/hp) steam 54 from a heat recovery steam generator (HRSG) 56. HT/HP steam 54 has a temperature of about 1050° F. and a pressure of approximately 2000 psia. During operation, a portion of ht/hp steam 54 flows along shaft 8 within packing assembly 10 towards second turbine section 6. HT/HP steam 54 entering second turbine section 6 impacts an overall efficiency of steam turbine 2. Towards that end, it is desirable to control leakage about shaft 8.

Figure 2:
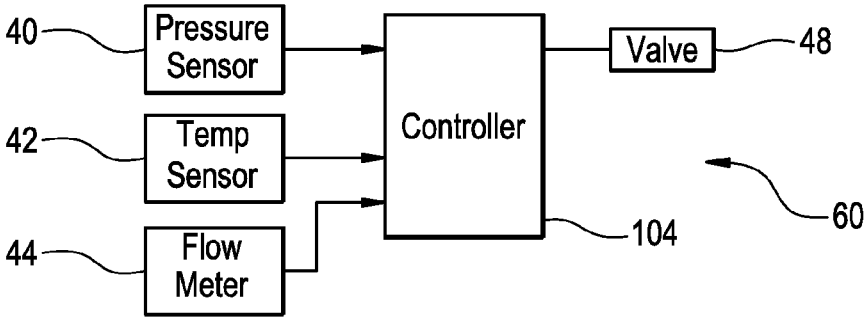
FIG. 2 is a block diagram of a system for determining leakage between the HP and IP turbines.

In order to determine the amount of leakage within packing assembly 10, steam turbine 2 includes a leakage measuring system 60 illustrated in FIG. 2. Leakage measuring system 60 includes a controller 104 operatively connected to pressure sensor 40, temperature sensor 42, flow meter 44 and valve 48. As will be discussed more fully below, a flow of low temperature/low pressure (lt/lp) steam 164 is introduced into first conduit 14. lt should be understood that the term "low temperature/low pressure steam" refers to steam at a temperature and pressure that is lower than the high temperature/high pressure steam in first turbine section 4. Leakage measuring system 60 selectively opens valve 48 allowing ht/hp steam 54 within packing assembly 10 to mix with lt/lp steam 164 to form a combined homogenous steam flow 174 in second conduit 24. Controller 104 determines the amount of leakage of ht/hp steam based on parameters of at least the combined flow.

Figure 3:
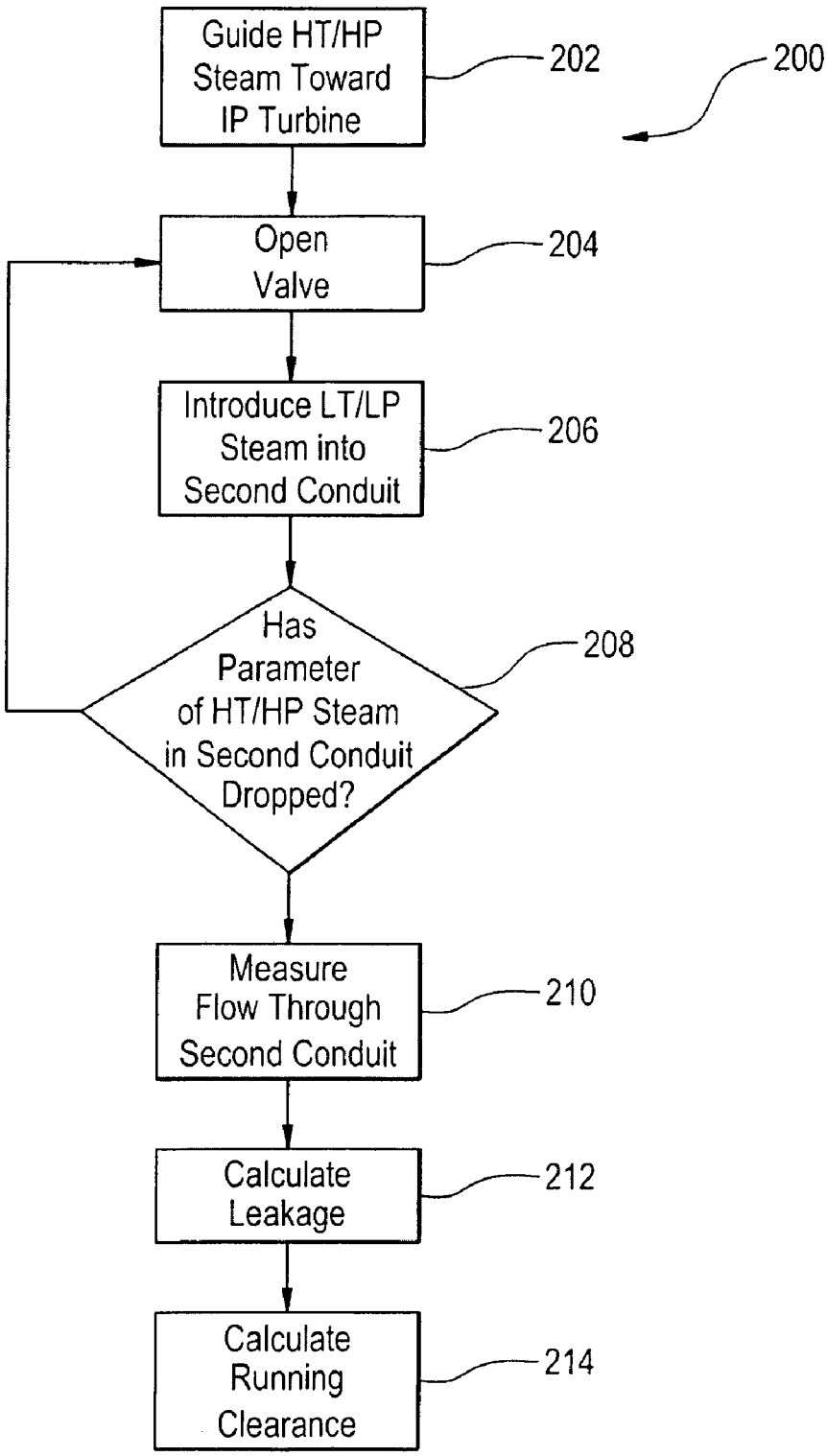
FIG. 3 is a flow diagram illustrating a method of determining leakage between the HP and IP turbines of FIG. 1.

Reference will now be made to FIG. 3 in describing a method 200 of determining an amount of ht/hp steam leaking into packing assembly 10. Initially, ht/hp steam 54 is caused to flow from first turbine section 4 along packing assembly 10 towards second turbine section 6 as indicated in block 202. The ht/hp steam 54 originates with the operation of steam turbine 2. Once steam turbine 2 has reached operational levels, valve 48 is opened as indicated in block 204. As pressure drops within packing assembly 10 lt/lp steam 164 having a known temperature and a known pressure begins to flow toward second conduit 24 as indicated in block 206. Controller 104 monitors temperature and pressure of steam passing though second conduit 24. Valve 48 continues to be opened causing a pressure drop in second conduit 24. The pressure of ht/hp steam 54 continues to fall until lt/lp steam 164 enters second conduit 24 to form combined steam flow 174. Once a parameter, e.g., temperature, of the combined flow begins to drop toward the predetermined temperature as sensed by temperature sensor 42, controller 104 queries flow meter 44 for a flow rate of combined flow 174 as indicated in block 210. Based on the formula provided below, controller 104 then and calculates an amount of ht/hp steam 54 leaking into packing assembly 10 as indicated in block 212. At this point, determining an effective hot running clearance or gap between packing assembly 10 and shaft 8 can be calculated in block 214.

$$Q=kA\eta$$

Where: k=flow coefficient base on packing type

A=flow path cross sectional area $\eta$=f(Pressure and packing geometry)

At this point it should be appreciated that the present invention provides a system and method of determining steam leakage in a steam turbine using known values instead of inferred parameters. The use of known values increases measurement accuracy allowing engineers to establish an effective running clearance between the shaft and packing assembly to enhance operation of the steam turbine. It should also be appreciated that while the low temperature/low pressure steam is described as emanating from an IP bowl section of the IP turbine, various other sources of lt/lp steam having known temperatures and pressures can be employed. Finally, it should be appreciated that the temperatures and pressures described above are for exemplary purposes and can vary within the scope of exemplary embodiments of the present invention.

In general, this written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the exemplary embodiments of the present invention if they have structural elements that do not differ from the literal language of the claims, or if they include equivalent structural elements with insubstantial differences from the literal language of the claims.

The invention claimed is:

1. A steam turbine comprising:

a first turbine section including a flow of high temperature, high pressure steam;

a second turbine section;

a shaft operatively connecting the first turbine section and the second turbine section;

a packing assembly positioned about the shaft, the packing assembly limiting an amount of the flow of high temperature, high pressure steam passing along the shaft from the first turbine section to the second turbine section;

a first conduit fluidly connected to the packing assembly, the first conduit being adapted to introduce a flow of low temperature, low pressure steam to the packing assembly;

a second conduit fluidly connected to the packing assembly downstream from the first turbine section and upstream from the first conduit, the second conduit receiving a portion of the high temperature, high pressure steam passing into the packing assembly from the first turbine section;

a valve fluidly connected to the second conduit, the valve being adapted to be selectively operated to allow the high temperature, high pressure steam to mix with the low pressure, low temperature steam in the second conduit;

one or more sensors mounted to the second conduit; and a controller operatively connected to the one or more sensors, the controller being programmed to determine an amount of high temperature, high pressure steam leaking into the packing assembly from the first turbine portion.

2. The steam turbine according to claim 1, wherein the one or more sensors include a flow meter fluidly connected to the second conduit, the flow meter detecting a flow parameter of steam passing through the second conduit.

3. The steam turbine according to claim 1, wherein the one or more sensors include a pressure sensor operatively connected to the second conduit, the pressure sensor detecting a pressure parameter of steam in the second conduit.

4. The steam turbine according to claim 1, wherein the one or more sensors include a temperature sensor operatively connected to the second conduit, the temperature sensor detecting a temperature parameter of steam in the second conduit.

5. The steam turbine according to claim 1, further comprising: a condenser, the second conduit leading from the packing assembly to the condenser.

6. The steam turbine according to claim 1, wherein the second turbine includes a flow of low temperature, low pressure steam, the flow of low temperature, low pressure steam passing from the second turbine section to the first conduit.

7. The steam turbine according to claim 1, wherein the first turbine section is a high pressure turbine section and the second turbine section is an intermediate pressure turbine section.

8. The steam turbine according to claim 1, further comprising: a heat recovery steam generator operatively connected to the first turbine section.

9. A method of determining a leakage within a steam turbine having first and second opposing turbine sections connected by a shaft surrounded by a packing assembly, the first turbine section leaking high temperature high pressure steam along the shaft within the packing assembly, the steam turbine having a first conduit connected to the packing assembly and a second conduit connected to the packing assembly between the first conduit and the first turbine section, the method comprising:

guiding the high temperature, high pressure steam through the second conduit;

introducing a low temperature, low pressure steam into the first conduit;

passing the low temperature, low pressure steam along the shaft toward the second conduit;

operating a valve fluidly connected to the second conduit;

mixing the high temperature, high pressure steam and the low temperature, low pressure steam in the second conduit to form a combined steam flow;

measuring at least one parameter of the combined steam flow;

adjusting the valve until the at least one parameter of the combined steam flow drops relative to a corresponding at least one parameter of the high temperature, high pressure steam flow; and calculating an amount of high temperature, high pressure steam leaking from the first turbine section along the shaft toward the second turbine section based on the combined steam flow.

10. The method of claim 9, further comprising: determining a running gap between the shaft and the packing assembly based on the amount of high temperature, high pressure steam leaking from the first turbine section.

11. The method of claim 9, further comprising: measuring a flow rate of the combined steam flow through the second conduit.

12. The method of claim 9, wherein introducing the low temperature, low pressure steam into the first conduit comprises passing the low temperature, low pressure steam from the second turbine section into the first conduit.

13. The method of claim 9, further comprising: passing the combined steam flow from the second conduit to a condenser.

14. The method of claim 9, wherein adjusting the valve until the at least one parameter of the combined steam flow drops relative to a corresponding at least one parameter comprises adjusting the valve until a temperature of the combined steam flow drops relative to a temperature of the high temperature, high pressure steam flow.

* * * * *